United States Patent [19]

Zaruba

[11] 4,282,680

[45] Aug. 11, 1981

[54] MANUALLY OPERATED FREQUENCY CHANGER ON WHEELED TOY WITH LED'S

[75] Inventor: John V. Zaruba, Chicago, Ill.

[73] Assignee: Marvin Glass & Associates, Chicago, Ill.

[21] Appl. No.: 116,941

[22] Filed: Jan. 30, 1980

[51] Int. Cl.[3] ..... A63H 33/26; A63H 11/10; A63H 5/00

[52] U.S. Cl. ..... 46/227; 46/228; 46/112; 46/204; 46/232

[58] Field of Search ..... 46/227, 228, 204, 74 D, 46/201, 202, 111, 112, 232, 248, 251, 229, 230; 200/11 TW, 11 G, 11 A, 24, 21

[56] References Cited

U.S. PATENT DOCUMENTS

| | | | |
|---|---|---|---|
| 1,637,479 | 8/1927 | Evelyn | 46/228 |
| 2,481,033 | 9/1949 | Nelsen | 200/11 G |
| 3,233,362 | 2/1966 | Chapman | 46/229 |
| 3,346,708 | 10/1967 | Morra | 200/11 G |
| 3,394,491 | 7/1968 | Valentine | 46/227 |
| 4,034,502 | 7/1977 | Breslow et al. | 46/204 |
| 4,055,014 | 10/1977 | Schmidt | 40/442 |
| 4,160,339 | 7/1979 | Dankman et al. | 46/227 |
| 4,175,353 | 11/1979 | Pickett | 46/227 |

*Primary Examiner*—Gene Mancene
*Assistant Examiner*—Michael J. Foycik
*Attorney, Agent, or Firm*—Mason, Kolehmainen, Rathburn & Wyss

[57] ABSTRACT

An animated action toy for young children and the like includes a hollow body in the shape of a bug having a front end portion and wheels for rolling support of the bug over a support surface in manually controlled diverse directions. A control cap is mounted for manual rotation on the body for controlling an electrical element of a circuit therein which generates an audible tone projected from a speaker mounted in the body. Rotation of the control cap provides a change in the frequency of the audible tone and a switch activated by rotation of the wheels is provided for periodically interrupting the tone generated by the electric circuit. The hollow body is formed with a face-like design at the front end having a pair of eyes in the form of light emitting elements which are energized periodically as the body is moved to resemble blinking of the bug's eyes during play.

14 Claims, 5 Drawing Figures

MANUALLY OPERATED FREQUENCY CHANGER ON WHEELED TOY WITH LED'S

BACKGROUND OF THE INVENTION

1. Field of the Invention

The present invention relates to an animated action toy and more particularly to an action toy especially designed for use by young children and adapted to provide both visual and audible signals during play. More particularly, the animated action toy is especially designed for manually controlled movement over a support surface and is useful in developing hand/eye coordination by providing both visual and audible responses in proportion to manually controlled input applied to the toy.

2. Description of the Prior Art

A wide variety of animated toys have been developed over the years for young children. A great many of these toys have provided audible signals when manipulated to move over a supporting surface and some toys have provided visual signals as well.

OBJECTS OF THE PRESENT INVENTION

It is an object of the present invention to provide a new and improved animated action toy for young children and the like and more particularly, to provide a new and improved mobile toy which is adapted for manually controlled movement over a supporting surface during play.

Another object of the present invention is to provide a new and improved animated action toy having the shape and dress of a bug or insect and readily movable during play to generate both audible and visual signals in response to the movement.

Yet another object of the present invention is to provide a new and improved animated action toy of the character described which is especially well adapted for improving hand/eye coordination of young children and the like during play.

Yet another object of the present invention is to provide a new and improved animated action toy having a control cap mounted on the body thereof for selectively controlling an electrical circuit which generates an audible tone from a speaker.

Still another object of the present invention is to provide a new and improved animated action toy of the character described which includes an electric circuit generating an audible tone sounding like a bug or insect and provided with switch means activated by rotation of the supporting wheels for periodically interrupting the tone in response to the movement of the toy.

Yet another object of the present invention is to provide a new and improved animated action toy of the character described including a pair of light emitting elements which appear as blinking eyes on the body of the toy as it is moved around over a playing surface.

Another object of the present invention is to provide a new and improved animated action toy which includes an audio oscillator connected to drive a speaker and operable to generate a pulsed, audible frequency selectively controlled by manual control element on the toy.

Yet another object of the present invention is to provide a new and improved animated action toy of the character described which is neat and pleasing in appearance, simple and fun to play with and which is capable of maintaining the attention of a young child for long periods of time at play.

SUMMARY OF THE INVENTION

The foregoing and other objects and advantages of the present invention are accomplished in an illustrated embodiment commprising a new and improved animated action toy adapted for manually controlled movement over a supporting surface. The toy comprises a hollow body in the shape of a bug or insect and having a head at a front end portion thereof. Wheel means is provided for supporting the body for rolling movement in diverse directions over a playing surface. A control cap is mounted for manual rotation relative to the body for controlling an electrical element therein which in turn is incorporated into an electrical circuit which generates an audible tone through a speaker mounted in the body. Movement of the control cap changes the frequency of the tone in response to the rotative position thereof on the body and switch means activated by rotation of the wheels is provided for periodically interrupting the tone generated by the electrical circuit.

In accordance with another feature of the invention, the body includes a head portion having a pair of light emitting elements mounted thereon and connected in the circuit means to produce flashes of light resembling the blinking of eyes in response to rotation of the wheels as the toy is moved over the playing surface.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
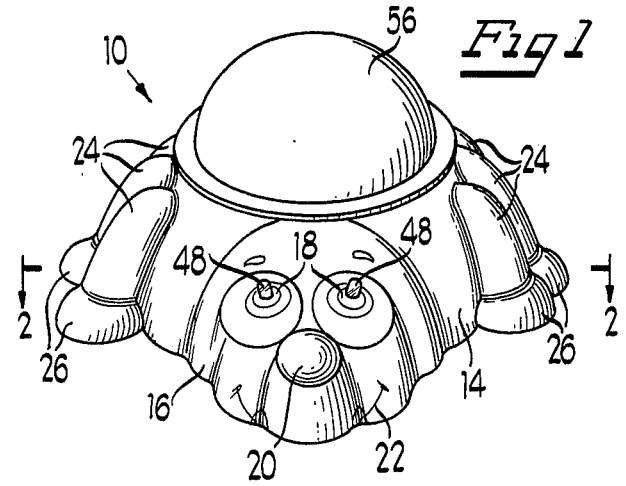
FIG. 1 is a front perspective view of a new and improved animated action toy constructed in accordance with the features of the present invention.

Referring now more particularly to the drawings, in FIG. 1 is illustrated a new and improved animated action toy especially adapted for use by young children and the like and referred to generally by the reference numeral 10. The toy is adapted for manually controlled movement over a supporting play surface 12 and includes a hollow housing having an upper portion 14 which is shaped and decorated to generally resemble an insect or bug.

Preferably, the housing is formed of molded plastic material and at a forward end is formed with a head section 16 having a pair of eyes 18, a nose 20 and a mouth 22. On opposite sides of the body of the bug is formed with a plurality of leg-like projections 24 having feet 26 at the lower end.

Figure 2:
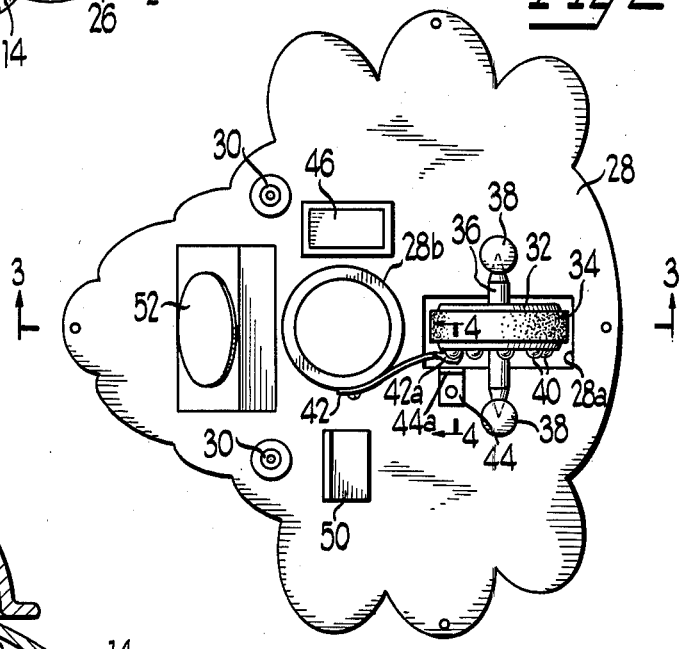
FIG. 2 is a horizontal, cross-sectional view taken substantially along lines 2—2 of FIG. 1.

A lower end of the hollow body 14 is enclosed by a flat bottom wall 28 also formed of molded plastic material and shaped with an outline as shown in FIG. 2 to seat within a peripheral shoulder or groove 14*a* provided around the lower peripheral edge or skirt on the inside surface of the hollow body shell. The toy is supported for manually controlled rolling movement in diverse directions over the playing surface 12 by means of a pair of small casters 30 spaced forwardly of a center portion of the body and disposed on opposite sides of a longitudinal center line thereof. The casters are secured to the bottom wall 28 and permit movement of the toy in any selected diverse direction over the supporting play surface.

In addition to the swiveling casters 30, the toy is provided with a friction wheel 32 having a rim or tire of sponge rubber material 34 adapted to engage the playing surface 12 as the toy is moved around. The wheel is supported on an axle 36 having pointed opposite ends mounted in upstanding brackets 38 formed on the bottom wall 28 as best shown in FIG. 2. A lower portion of the wheel projects downwardly through a rectangular slot 28*a* formed in the bottom wall 28 on the center longitudinal center line thereof and spaced rearwardly of the center of the toy. On one side of the wheel, there is formed a ring of circumferentially spaced apart switch actuator elements 40 which project laterally outwardly thereof and which are substantially hemispherical in shape.

Figure 3:
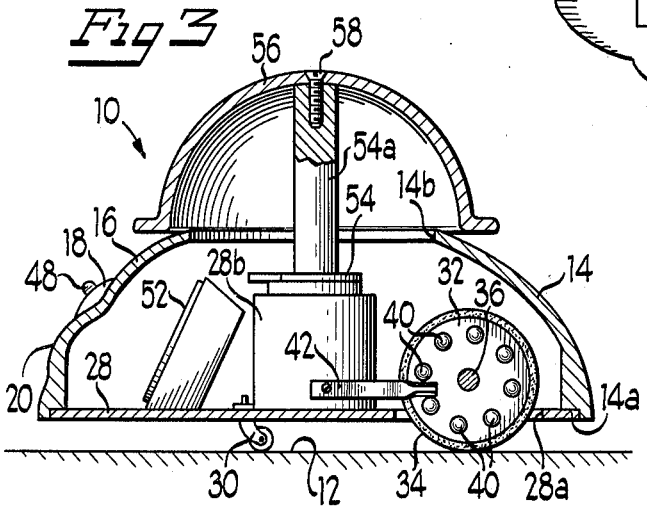
FIG. 3 is a vertical, longitudinally extending cross-sectional view taken substantially along lines 3—3 of FIG. 2.
Figure 4:
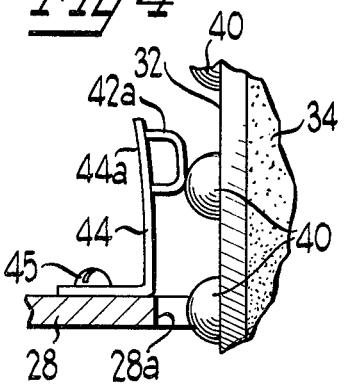
FIG. 4 is a fragmentary, enlarged cross-sectional view taken substantially along lines 4—4 of FIG. 2.
Figure 5:
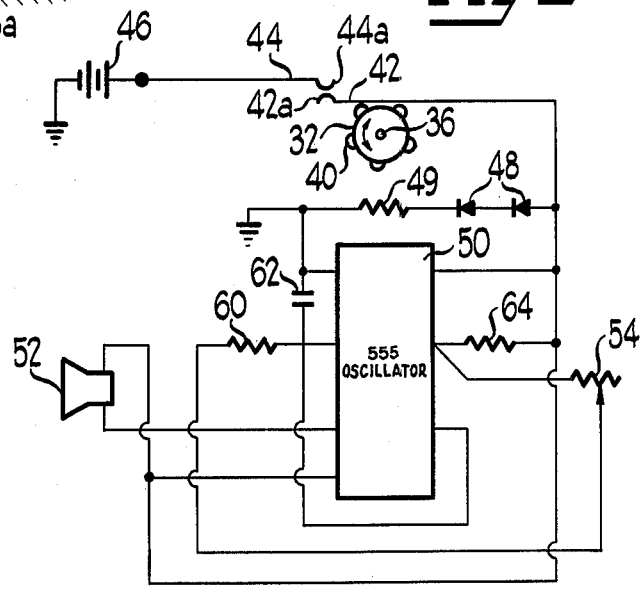
FIG. 5 is a schematic diagram of an electrical circuit for the animated toy in accordance with the features of the present invention.

The actuators are adapted to engage and deflect the free outer end portion 42*a* of an elongated switch element 42 having an opposite end fixedly mounted on a centrally disposed, upstanding cylindrical boss 28*b*, integrally formed on the upper side of the bottom wall 28. As illustrated in FIGS. 2, 3 and 4, the free end portion 42*a* of the elongated switch element 42 is biased toward the adjacent flat side of the wheel 32 and is moved outwardly away by the actuators 40. The free end portion 42*a* is formed into a U-shaped, transverse, cross-section as shown in FIG. 4 having a dimension slightly less than the circumferential spacing between adjacent pairs of switch actuator 40 in the ring around the side of the wheel. As illustrated in FIG. 2, the switch element 42 is normally biased to rest against the flat side of the wheel 32 and normally rests between adjacent switch actuator 40 when the wheel is not turning. When the wheel rotates, the actuators engage the free end portion 42*a* in rapid sequence and bias the switch outwardly away from the side of the wheel to make contact with an upstanding leg 44*a* of an L-shaped, stationary switch element 44 secured to the housing bottom wall 28 by a suitable fastener 45 as shown in enlarged detail in FIG. 4. Each time the wheel 32 rotates one complete revolution, the switch formed by the elements 42 and 44 is opened and closed a plurality of times depending upon the number of actuator elements 40 provided on the side of the friction wheel. The rate of opening and closing of the switch is dependent upon the speed of rotation of the wheel which in turn is responsive to the speed and direction of movement or travel of the toy 10 over the playing surface 12.

As shown in FIG. 3, the switch element 42 is mounted to extend in a generally radial direction with respect to the axis of rotation of the friction wheel 32 and movement of the toy in either a forward or rearward direction relative to the wheel axle 36 is effective to open and close the switch contacts in said succession.

The switch is connected in series with a battery 46 to control a D.C. current supplied to a pair of light emitting elements such as light emitting diodes 48 which are connected in series and in series with a resistance 49 of appropriate value (for example, 390K) when a 9 volt, transistor battery is utilized.

In accordance with the present invention, whenever the switch contacts 42 and 44 are closed together, D.C. voltage from the battery 46 is supplied to an audio oscillator 50 which may comprise a modular unit on a printed circuit board of a type such as an NE-555P capable of generating a frequency in the audible range. The output of the oscillator is connected to a speaker 52 mounted in the body 14 in front of the central boss 28*b* as shown in FIGS. 2 and 3. The frequency of the printed circuit type oscillator 50 is selectively controllable by means of a potentiometer 54 mounted on the upper surface of the central boss 28*b* with an upwardly extending control shaft 54*a*. The shaft provides support for a hemispherically-shaped, control cap 56 which is rotative relative to the lower portion of the housing 14 and which covers an enlarged opening 14*b* provided in the upper portion thereof as shown in FIG. 3. The control cap 56 is secured to the upper end of the potentiometer shaft 54*a* by a suitable fastener such as threaded cap screw 58 and is keyed against relative rotation on the shaft so that when the cap is rotated in either direction with respect to the body of the toy, the effective resistance of the potentiometer 54 is increased or decreased. The effective resistance of the potentiometer controls the amount of feedback in the oscillator circuit and the frequency of the audio output from the oscillator 50. The potentiometer 54 is of an appropriate valve such as 250 K and the movable contact or wiper thereof is in series with a resistor 60 of appropriate value such as 3.3 K. The potentiometer 54 is of the type that permits the shaft 54*a* to be rotated through 360° relative to the body and thus, there are no limitations on the direction or amount of rotation of the control cap 56. A capacitor 62 is connected between ground and one input terminal of the printed circuit component 50 and a resistor 64 is connected between a positive power supply lead and another input terminal on the circuit board that is common with one of the fixed terminals of the potentiometer 54. The capacitor 62 has an appropriately chosen capacity of 0.02 ufd. and the resistor 64 has a capacity of 6.8 K.

The output frequency provided by the oscllator circuit of the printed circuit board 50 produces an audible sound through the speaker 52 resembling that of an insect or bug in periodic pulses depending upon the speed and direction of movement of the toy over the playing surface. The frequency of the audible tone generated is variable and dependent upon the relative position of the movable wiper contact of the potentiometer 54 as controlled by the position of the control cap 56 relative to the body 14. Rotation of the cap in one direction causes the frequency of the audio tone to move lower and rotation in an opposite direction increases the frequency. The frequency or interval of the pulses is determined by the speed and direction the toy is moved to rotate the friction wheel 32.

When the toy is at rest, the free end portion 42*a* of the switch element 42 is out of contact with the switch terminal 44 to shut off power to the oscillator circuit.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An animated action toy for manually controlled movement over a support surface, comprises:

a hollow body having a front end portion and wheel means for rolling support of said body for movement in diverse directions over said support surface;

a control cap mounted for manual rotation relative to said body for controlling an electrical element therein;

electrical circuit means for generating an audible tone from speaker means thereof including said electrical element for controlling the frequency of said tone in response to the rotation position of said cap; and switch means activated by rotation of said wheel means for periodically interrupting said tone generated by said circuit means.

2. The animated action toy of claim 1 including at least one light emitting element mounted on said body and connected in said circuit means to produce flashes of light in response to rotation of said wheel means.

3. The animated action toy of claim 2 including a pair of said light emitting elements mounted on said front end portion of said body to resemble a pair of blinking eyes upon rotation of said wheel means.

4. The animated action toy of claim 1 wherein said circuit means includes an audio oscillator connected to drive a speaker and generating an audible frequency selectively controlled by said electrical element.

5. The animated action toy of claim 1 or 4 wherein said electrical element comprises means mounted in said body having a control shaft supporting said cap for selective manual rotation thereon.

6. The animated action toy of claim 1 wherein said wheel means includes a switch control wheel driven to rotate by movement of said body with said wheel in frictional contact with said support means, and at least one switch actuator carried on said wheel for movement therewith to activate said switch means as said wheel is rotated.

7. The animated action toy of claim 6 wherein said wheel means includes a pair of casters mounted for castoring movement on said body and said switch control wheel is mounted for rotation on an axis in fixed relation to said body.

8. The animated action toy of claim 6 wherein said control wheel is provided with a plurality of circumferentially spaced apart switch actuators for opening and closing said switch means a plurality of times for each revolution of said control wheel.

9. The animated action toy of claim 8 wherein said switch means includes a first contact member spaced from said wheel and a second contact member engaged by said actuators on said wheel to deflect the second contact member with respect to said first contact member as said wheel rotates.

10. The animated action toy of claim 9 wherein said contact members are normally open and are closed when said actuators on said wheel are deflectively engaging said second contact member to touch said first contact member.

11. The animated action toy of claim 10 wherein actuators are mounted in a ring on one side of said wheel in coaxial alignment around the axis of rotation thereof.

12. The animated action toy of claim 11 wherein said second contact member extends radially of said wheel axis and is deflectable outwardly of said wheel side by said actuators to make contact with said first contact member.

13. The animated action toy of claim 12 wherein said second contact member includes a free outer end extending into the path of said ring of actuators and adapted to rest between a pair of adjacent actuators out of contact with said first contact member.

14. The animated toy of claim 13 wherein said actuators have convexly rounded outer surface extending outwardly of said wheel side.

* * * * *